United States Patent [19]

Meyer

[11] Patent Number: 4,507,906

[45] Date of Patent: Apr. 2, 1985

[54] HINGED BAG TOP FOLDER

[75] Inventor: James A. Meyer, Deronda, Wis.

[73] Assignee: Doboy Packaging Machinery, Inc., New Richmond, Wis.

[21] Appl. No.: 423,552

[22] Filed: Sep. 27, 1982

[51] Int. Cl.[3] ..... B65B 7/16

[52] U.S. Cl. ..... 53/371

[58] Field of Search ..... 53/371, 372, 373, 378, 53/381 R, 383, 481, 482; 493/157, 255, 260, 455

[56] References Cited

U.S. PATENT DOCUMENTS

| | | | |
|---|---|---|---|
| 2,576,472 | 11/1951 | Messmer et al. | 53/371 |
| 3,200,558 | 8/1965 | Adams et al. | 53/383 |
| 3,720,559 | 3/1973 | Odom et al. | 53/372 X |

*Primary Examiner*—Robert L. Spruill
*Assistant Examiner*—Richard M. Mudd
*Attorney, Agent, or Firm*—Orrin M. Haugen; Thomas J. Nikolai; Douglas L. Tschida

[57] ABSTRACT

In a packaging machine, a folder assembly for folding the tops of bags as part of a ceiling operation wherein the folder assembly can accommodate irregularities in the bags without jamming. A first folding station includes a stationary support member to which is hingedly affixed a first and a second folder plate, each having predetermined profiles formed along a working edge thereof. These folder plates are resiliently biased by springs toward their associated support member such that limited freedom to yield in a vertical plane is achieved. Associated with the working edge and spaced slightly therefrom is a front fold blade which, too, is spring mounted to allow a limited yield in a horizontal plane. In the event a jam should occur, the assembly may be readily opened to facilitate the clearing of that jam.

16 Claims, 9 Drawing Figures

HINGED BAG TOP FOLDER

BACKGROUND OF THE INVENTION

1. Field of the Invention

This invention relates generally to packaging machinery and more specifically to an improved folder assembly for introducing a 180° (single fold) or a 360° (double fold) to the open top of a bag as the bag is transported through the packaging machine during a sealing operation.

2. Discussion of the Prior Art

In packaging machines used to seal paper bags containing a solid product, the open end of the bag is generally gripped between parallel flights of two endless chains and carried through a top trimmer station and either one or two creasing and folding stations where the previously opened end of the bag is folded over either once or twice to close and seal the bag. It is also a common practice to provide a suitable adhesive on the folded portion of the bag so that it will remain closed and sealed following discharge from the packaging machine.

In prior art bag sealing machines, the folder used to wrap or fold the end of the bag closed is generally a sheet metal member which is formed in a bending process to provide a predetermined profile in the path of the bag as it is carried along through the packaging machine. The profile is such that the open end of the bag is bent first at a 90° angle, then to a 180° angle, at which point a hot melt adhesive may be applied to the exposed folded surface of the bag. The bag may then be transported through a second similar formed sheet metal folding station where the end of the bag is further folded to a 270° degree point and then to a 360° point, resulting in a double wrapped closure.

The formed sheet metal folders of the prior art have suffered from two principal drawbacks. First of all, because of irregularities in the thickness of the material forming the open end of the bag to be closed, and because of the fact that there is substantially no give to the sheet metal folder, the bags tended to become jammed in the folding stations required that the machine be shut down while the jam is cleared. Again, because of the nature of the sheet metal folders employed, it proves quite difficult to clear the jam, often requiring the folding station to be disassembled from the machine so that adequate access may be had to remove the torn paper material jammed into the folder. Naturally, frequent jamming and long down-time to clear a jam seriously limits the through-put of the machine.

The present invention is deemed to be an improvement over the prior art in that it provides a folder assembly which is much less subject to jamming and which may readily be cleared if and when a jam should occur.

SUMMARY OF THE INVENTION

In its simplest form, the present invention comprises a generally horizontally disposed stationary member having a top plate superposed thereon and hingedly attached along an edge thereof such that the top plate may be rotated upwardly relative to the stationary member. Disposed proximate the opposed side edge of the top plate are first and second folder members, each of which is provided with a machined profile which, when in use, is directly in the path of the open end of a bag as the bag is carried by means of a conveyer through the packaging machine. The profile on the first folder member causes the top open edge of the bag to be folded at 90° relative to a vertical axis as that bag passes through the first folder member. Upon exiting from that folder member, it intersects with the profile of the second folder member which is machined so as to cause the top of the bag to next be folded an additional 90°. Cooperating with the working edge of the first fold member is a front fold blade which is adjusted so as to have a predetermined gap between it and the support plate, the gap being set to accommodate the thickness of the bag to be folded.

Both the top plate on which the first and second fold members are attached and the front fold blade are resiliently mounted with respect to stationary members with which they cooperate by means of suitably positioned springs. Because the top plate is resiliently mounted with respect to its underlying support plate, variations in thickness of the bag can cause the top plate to rotate in a vertical direction while the spring bias on the front fold blade allows the lateral gap to increase should there be an irregularity in the bag passing through the folding station. Because of the "give" allowed by the spring adjustment members, the tendency for a bag to jam is substantially reduced. Then, because both the front fold blade and the top plate are relatively movable with respect to their associated mounting structures, it is an easy matter to open up the entire folding assembly to clear a jam should one occur.

OBJECTS

It is accordingly a principal object of the present invention to provide an improved folder assembly for use in high-speed packaging machinery.

Another object of the invention is to provide an improved folding station for use in high-speed packaging machinery which can be used to wrap the open end of a paper bag as it passes through the machine. Still another object of the invention is to provide a folder assembly for use in a high-speed packaging machine which is less subject to jamming than prior art designs.

Yet another object of the invention is to provide a folder assembly for a high-speed packaging machine which may readily be manipulated to clear a jam in the event one should occur.

A yet further object of the invention is to provide a bag folder for an automatic packaging machine which can accommodate irregularities in the bags being processed and which can be readily adjusted so as to accommodate bags of differing material thickness.

These and other objects and advantages of the invention will become apparent to those skilled in the art from the following detailed description of a preferred embodiment when considered in conjunction with the accompanying drawings in which:

FIG. 1 is a schematic mechanical diagram showing the environment in which the present invention finds use; and FIGS. 2(*a*) through 2(*f*) illustrate a bag in various stages of being folded; and FIG. 3 comprises a blown-apart view of the folder assembly of the present invention; and FIG. 4 is a partial top view showing the relative positioning of the folders with respect othe center line of the conveyer.

DESCRIPTION OF THE PREFERRED EMBODIMENT

Figure 1:
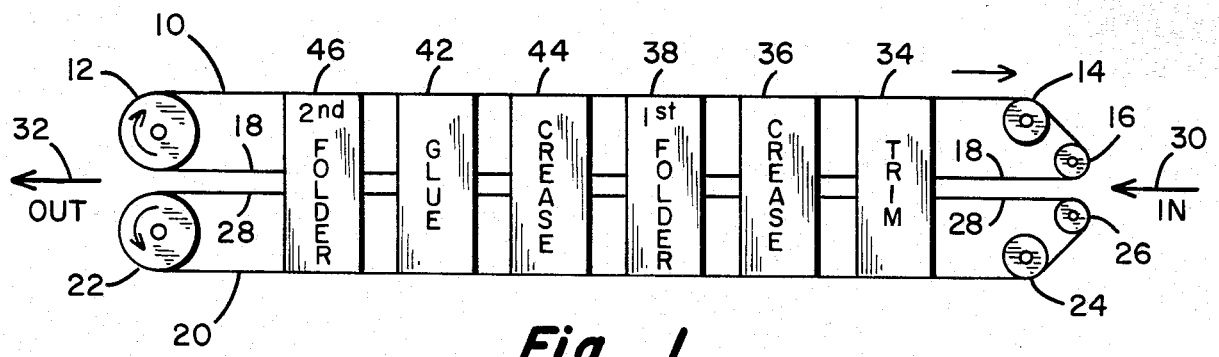

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof, and words of similar import.

Before describing in detail the structural features and operational characteristics of the bag top folder of the present invention, it is deemed helpful to explain the type of apparatus in which the invention finds use. In this regard, reference is made to the schematic mechanical diagram of FIG. 1. It is intended to depict, by means of a top or plan view, the portion of a packaging machine used for folding and sealing the tops of paper bags in which various commodities may be packaged. The overall machine is shown as including a first endless carrier chain 10 which is routed around a series of sprocket wheels 12, 14 and 16 so as to define a relatively straight line flight 18. Similarly, a second endless chain 20 is routed about sprocket wheels 22, 24 and 26, creating a second straight line flight 28 between the sprockets 22 and 26. The sprocket wheels are each journeyed on a frame for rotation about a vertical access. The sprocket wheels are positioned relative to one another such that the flights 18 and 28 are maintained in a parallel, close but none contact relationship with respect to one another. The sprocket wheels 12 and 22 are driven in opposite directions such that the flights 18 and 28 of the carrier chains move together at the same speed and in the same direction. The apparatus thus far described comprises a conveyer for transporting filled paper bags in the direction indicated by the arrows 30 and 32 from an infeed end to a discharge end. Because of the close spacing between the parallel flights 18 and 28, the top portion of a bag is firmly gripped between the two flights with the open end projecting above the conveyer and the remainder of the bag containing the contents disposed below the conveyer.

In moving through the packaging machine in the direction indicated, the open end of the bag passes through a trimming station 34 whereby the top of the bag is trimmed so as to be a precise predetermined height above the plane of the conveyer. Next, the portion of the bag exposed above the carrier chains is passed through a creasing assembly 36 which may comprise a pair of closely spaced wheels having a circular knife-like edge projecting from their peripheral surfaces, the wheels being driven so that the bag material passing between the two wheels is impressed with a thin, indented line (FIG. 2*a*) which subsequently forms a preferred location for the bending or folding of the bag material.

Figure 2:
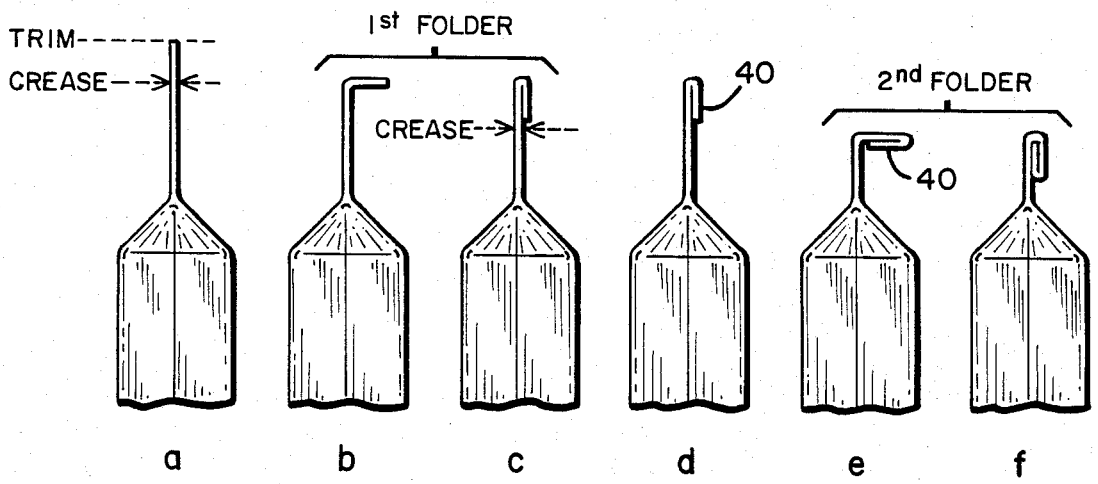

Upon leaving the creasing assembly 36 the bag passes to the first folder station 38 and upon passing through it, the top portion of the bag is folded along the crease line first as is illustrated in FIG. 2(*b*) and then as illustrated in FIG. 2(*c*).

Upon leaving the first folder station 38, the bag passes through a second creasing device 44 to form a crease line at the location indicated in FIG. 2(*d*). Following that, a hot melt glue or other pressure sensitive adhesive may be applied to the surface 40 (FIG. 2*c*) at the gluing station 42.

Next, the bag progresses to the second folder station where the top of the bag is again folded along the crease line first as is indicated in FIG. 2(*e*) and then as in FIG. 2(*f*). In that the surface 40 has an adhesive applied thereto, when the bag is folded as in FIG. 2(*f*), the adhesive serves to hold the bag in the folded position as it exits the packaging machine.

Now that overall understanding of the system has been provided, attention will next be directed to the constructional features of the folder mechanisms employed at the folder stations 38 and 46, respectively.

Figure 3:
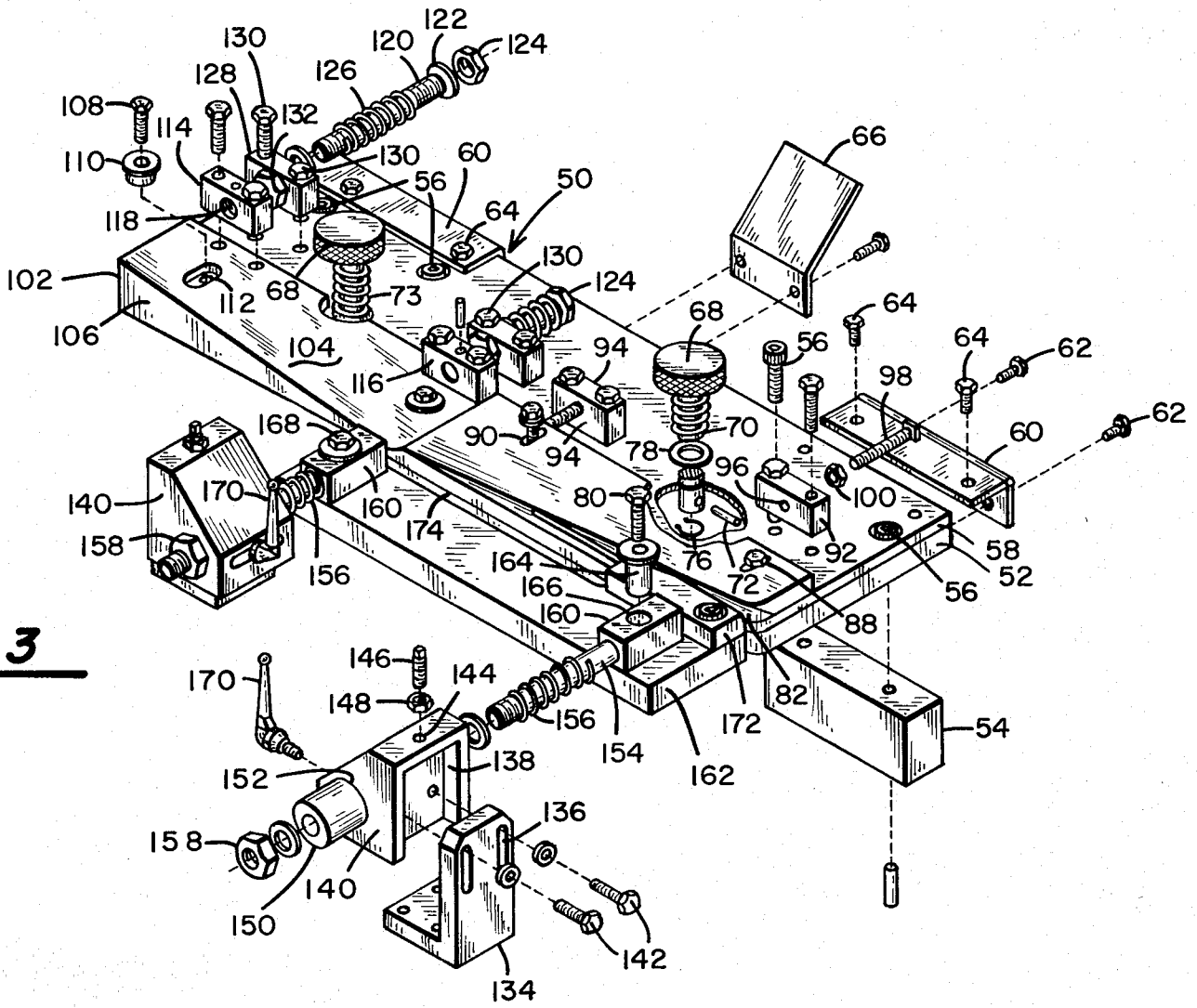

Referring to FIG. 3, the folder assembly of the present invention is indicated generally by numeral 50 and includes a base plate 52 which is arranged to be mounted horizontally a predetermined distance above the plane of the carrier chains 10 and 20 of FIG. 1, the spacing being maintained by a pair of properly dimensioned spacer blocks 54 which are bolted to the undersurface of the base plate 52 by screws 56.

Hingedly affixed to the base plate 52 is a top plate member 58. More specifically, hinges 60 have a first half thereof affixed to the side edge of the base plate 52 by means of screws 62 and the other half is secured to the upper surface of the top plate 58 by the screws 62. Thus, the top plate may be rotated upwardly out of its horizontal disposition as will be described in greater detail below. A stop member 66 is bolted to the rear edge surface of the base plate 52 and limits the extent to which the top plate 58 may be rotated. It also serves as a rest for the top plate when it is in its open position relative to the base plate 52.

The top plate 58 is normally held in a closed position relative to the base plate 52 by means of spring loaded knobs 68. As can be seen from the blown apart view, the knobs 68 are each mounted on a shaft at 70 which have a pin 72 passing through a radius bore formed through the lower end of the shaft. A snap ring 76 is arranged to fit in a circumferential recess formed in the shaft so as to support and capture a washer 78. In each case, the shaft 70 of the spring loaded knob 68 passes through a hole bored through the thickness dimension of the top plate 58. Located immediately below the holes in the top plate are further holes in the base plate of a larger diameter in which a slotted socket (not shown) is inserted. The pin 72 cooperates with the socket on underside of the plate 52 when the top plate is being clamped. When in this condition, the top plate 58 is resiliently held against the base plate by the coil spring 73, but if a separating force is applied between the two, the top plate is free to lift, within limits relative to the base plate 52. When it is desired to open the assembly, one pushes down on the knob 68, compressing the springs 73 surrounding the shafts and by simultaneously rotating the knob a quarter turn, the pin 72 is made to align with a slot in the socket such that it is free to pass through the base plate 52, allowing the top plate 58 to be opened, as previously described.

Figure 4:
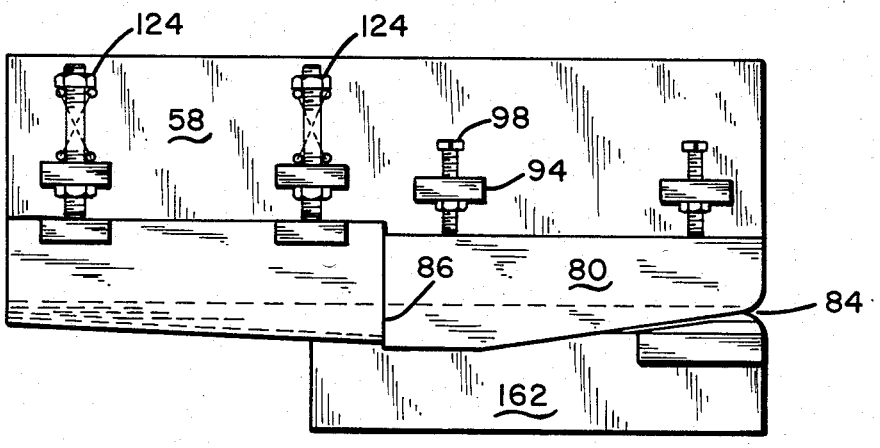

Attached to the upper surface of the top plate 58 is a first folder member 80. More specifically, disposed adjacent the front edge of the top plate 58 is a block comprising the folder 80, the block having a downwardly and inwardly extending chamfer 82 formed on the frontmost longitudinal edge. This working edge extends at a predetermined acute angle to and intersects with a vertical plane aligned with the center of the conveyer chain flights 18 and 28. As can best be seen in the plan view of FIG. 4, the folder 80 has a width which tapers outwardly at that angle from a rounded entrance point 84 towards the opposed side edge thereof 86.

The folder plate 80 is arranged to be held in place relative to the top plate 58 by means of bolts 88 which pass through transversely extending slots 90, the slots allowing lateral adjustment of the folder plate 80 relative to the top plate 58. In order to precisely position the working edge 82 of the folder 80 relative to the path of travel of bags, there are mounted on the top plate 58 first and second adjustment blocks 92 and 94. The adjustment blocks each have a threaded bore at 96 for receiving an adjustment screw 98 which is sufficiently long to pass through the adjustment blocks so that its end may abut the rear edge surface of the folder plate 80. By turning the screws 98 when the bolts 88 are loose, the folder plate 80 may be precisely aligned with respect to the path of travel of the bag. A locknut 100 positioned on the adjustment screws 98 serve to hold the precise adjustment once it has been achieved.

The folder 80 is designed to introduce a 90° bend to the top of a bag passing down the conveyer, the bend taking place at the location of the creaseline impressed in the bag. Once the top of the bag has been folded over at a 90° degree angle it passes to an additional folder member 102 which has a working surface arranged to introduce a second 90° fold such that when the bag exits the first folder station 38 (FIG. 1) the top of the bag will be folded in the manner indicated by FIG. 2(*c*).

The folder 102 comprises a plate 104 having a triangular sideplate 106 depending downwardly therefrom proximate the front edge of the top plate 58 and base plate 52. The folder 102 is secured to the top plate by means of bolts 108 which pass through slide guides 110 and into threaded bores 112 formed in the top plate 58. The plate 104 has an elongated slot adapted to receive the slide guide 110 such that limited lateral positioning of the folder member 102 is accommodated.

Bolted to the upper surface of plate 104 proximate the rear longitudinal edge thereof are first and second slide supports 114 and 116. These slide supports each include a threaded bore as at 118 for receiving a threaded end of a slide rod 120. A shim washer 122 is positioned on the other end of the slide rod and a locknut 124 is screwed on that end as well. The slide rod passes through the center of a coil compression spring 126 and through an unthreaded bore (not shown) formed in slide rod supports 128 which are bolted to the top plate 58 by bolts 130. Locknuts, as at 132, located between the slide support 114 and 128 are also threaded onto the slide rod 126. Using this arrangement of spring-loaded slide rods, it can be seen that the normal operating position of the downwardly depending triangular plate 106 can be laterally adjusted by rotating the adjustment nuts 132, yet the folder member 102 may move laterally, within limits, against the force of the springs 126 should there be a thickness irregularity in the bag being folded.

Attached to the conveyer's frame (not shown) are a pair of L-shaped adjustment mount supports 134, the supports having longitudinal slots 136 passing through the upstanding portion thereof. The supports 134 fit within a rectangular recess 138 formed in an adjustment mount member 140. The width of the rectangular recess in such that it can slide vertically relative to the edges of the upstanding portion of the L-shape support member 134. Screws 142 pass through the slots 136 and into threaded bores formed in the rear surface of the adjustment mount 140, the arrangement thereby allowing vertical positioning and locking of the adjustment mount relative to the conveyer frame. The adjustment mount 140 has a vertically extending threaded bore 144 passing through it and fitted within this bore is a setscrew 146 which cooperates with the top surface of the support 134. The set screw 146 is equipped with a locknut 148 and this arrangement allows precise adjustment of the elevation of adjustment mounts 140.

Sleeves 150 pass through bores 152 in the adjustment mounts 140 and the sleeves each include a central bore through which support shafts 154 are intended to pass. Coiled compression springs 156 surround the support shaft and the threaded end thereof projecting through the sleeve 150 is secured with a locknut 158.

The support shafts 154 are attached to blocks 160 which, in turn, are pivotally mounted on the upper surface of a front blade member 162. The pivotal mounting of the blocks 160 is accomplished through the use of a sleeve bearing 164 which fits within a slightly oversized bore 166 formed through the thickness dimension of the block 160. A cap screw 168 passes through the center of the sleeve 164 to attach it to the front blade member. Completing the front blade support assembly are locking handles 170 which have a threaded portion passing through a threaded bore formed through the sidewall of the support guide 150 and arranged to abut the surface of the adjustment mount 140 when tightened. When these clamps are loosened, the sleeve 150 may move freely through the adjustment mount 140 to allow lateral movement of the front blade 162 relative to the working edge of the folder member 80.

The folder assembly of FIG. 3 as thus far described comprises the mechanism for implementing the first folder station 38 of FIG. 1. The apparatus for implementing the second folder station 46 is practically identical to the arrangement of FIG. 3, but includes the addition of a further element 172, termed a flap guide. This flap guide 172 simply comprises a rectangular bar which is affixed to the upper surface of the front blade 162 immediately adjacent the point of entry of a bag into the folder assembly. It will be recalled that when a bag is moving into the second folder station, it has the configuration illustrated in FIG. 2(*d*). The flap guide 172 serves to prevent the previously folded portion of the bag from unfolding as it is brought into the second station.

It is also to be noted that the front blade 162 has a longitudinally extending slot 174 formed through its thickness dimension but inset from its working edge by a predetermined distance. It will be recalled from the earlier discussion of FIG. 1, before passing into the second folding station, the bag may have an adhesive layer applied to the surface 40 (FIG. 2). The recess 174 in the front blade member insures that this adhesive surface will not come into contact with the surface of the front blade member as the bag passes through the folder station, thus reducing possible fouling of the machine and sticking of the bags as they pass through.

OPERATION

In initially setting up the first and second folder stations, the front edge of the base plate 52 is adjusted to be aligned vertically above the center line of the carrier chain conveyer flights 18 and 28. This is achieved by loosening the screws 56 and manipulating the base plate until the desired alignment is achieved, at which point the screws are again retightened. Next, the front fold blade 162 is positioned relative to the working edge of the folder 58 by first loosening the clamp levers 170 and pushing the blade 162 away from the adjustment mounts 140 until the blade stops because of the contact between the clamp levers 170 and the end of the slots in supports 140. The gap between the front fold blade 162 and the base plate 52 should be approximately one and one-half times the thickness of the bag processed. In adjusting the gap, the locknuts 158 are turned in a clockwise direction to increase the gap and in a counterclockwise direction to decrease it. No further adjustment is required unless a change in the type of bag, i.e. its thickness, is made. Next, a one-fourth inch thick spacer gauge is placed on top of the base plate 52 and the top of the blade 162 is set at a level approximately one and one-half times the thickness of the bag below the top of the aforementioned gauge. This height adjustment is accommodated by the sliding fit between the adjustment mounts 140 and their associated supports 134. More particularly, the mounting screws 142 are first loosened and then the locking nut 148 on the set screw 146 is loosened. This allows the set screw to be turned to raise or lower the adjustment mount relative to the support.

Once the blade height has been set, the one-fourth inch spacer gauge may be removed and the top plate 58 closed relative to the base plate 52. During initial set-up, the top 90° folder 80 should be positioned so that its machined surface 82 is appropriately aligned with the gap which has been established between the front blade 162 and the stationary base plate 52. This adjustment is accomplished by loosening the screws 88 and the locking nuts 100 so that the adjustment screws 98 may be rotated. A clockwise rotation increases the gap while a counterclockwise rotation will decrease it. In adjusting the positioning of the 90° folder blade, it is desirable that the back edge of this folder be parallel to the front of the top plate 58.

The 180° folder member 102 is adjusted such that its infeed end is in proper alignment wth the outfeed end of the 90° folder member 80. In making this adjustment, the locknuts 132 are rotated either clockwise or counterclockwise depending upon the alignment desired. The discharge end of the 180° folder 102 should have a gap between it and the front fold blade 162 should be approximately one and one-half times the thickness of the bag. In making this adjustment, the locknut 132 is turned in an appropriate direction to either increase or decrease the relative spacing. The spring tension on the springs 126 is adjustable and should be just sufficient to cause folding of the bag. The spring tension, of course, is adjusted by manipulating the adjustment nut 124 on the end of the slide rod 120.

Once the folder assemblies have been adjusted in the manner described, it may begin creating a folded top on bags as they pass along the conveyer through the packaging machine. Upon leaving the first creasing station 36 and entering the first folder, the top portion of the bag will encounter the chamfered surface on the edge of the 90° folder 80 and because of the chamfered profile, the top portion of the bag will be effectively bent at a 90° angle with respect to the vertical. If, for any reason, a jam should occur at this point, it may be cleared by releasing the clamps 170 and sliding the front blade 162 toward the mounts 140. Also, in clearing a jam, it may be helpful to rotate the top plate 58 about its hinges 60. To do this, the operator depresses the knobs 68 against the force imparted by their associated coil springs such that the pin 72 clears its associated latch on the underside of the base plate 52 (not shown). Then by rotating the knob 90°, the pin is aligned with a slot (not shown) allowing the entire top plate assembly and the parts mounted thereon to be rotated until it comes to rest against the stop member 66. This maneuver completely exposes the top end of the bag, allowing the jam to be cleared.

Assuming that no jam has occurred while the bag is traversing the 90° folder 80, upon leaving that folder, it immediately intersects with the shaped edge formed on the undersurface of the 180° folder member 102. In traversing this zone, the top of the bag is turned 180° about the crease line.

The folder disposed at the second folder station 46 operates in substantially an identical manner. As mentioned above, the only difference in the folder located at the second folder station is the inclusion of the flap guide 172. This guide prevents the first 180° fold from the straightening out as the bag enters the second folding station. Again, any jams which may occur due to irregularities in bag thickness or the like are cleared in the fashion already described.

The invention has been described herein in considerable detail, in order to comply with the patent statutes and to provide those skilled in the art with information needed to apply the novel principals, and to construct and use such specialized components as are required. However, it is to be understood that the invention can be carried out by specifically different equipment and devices and that various modifications, both as to equipment details and operating procedures can be effected without departing from the scope of the invention itself.

What is claimed is:

1. In a bag sealing machine of the type having conveyer means mounted on a frame for transporting a bag to be sealed along a straight line path of travel from an infeed point to a discharge point with the top portion of the bag extending vertically upward from said conveyer means, a bag top folder disposed in said path to engage said top portion of the bag in its course of travel comprising:

(a) a stationary base plate affixed to said frame with one vertical edge thereof disposed above said conveyer and generally aligned with a vertical plane containing the center line of said conveyer;

(b) movable top plate means disposed on said base plate;

(c) first folder means attached to said top plate means and having a working edge extending at a predetermined angle to and intersecting said vertical plane containing said center line, said working edge having a chamfer;

(d) second folder means mounted on said top plate with a portion thereof overlaying said path of travel and having a working edge sloping downwardly toward said discharge point; and (e) movable front blade means having a working edge disposed in a parallel, non-contacting relationship with respect to said vertical edge of said base plate to allow the top of said bag to pass between said vertical edge of said base plate and said working edge of said movable front blade means.

2. The bag top folder as in claim 1 wherein said movable top plate is hingedly affixed to said stationary base plate.

3. The bag top folder as in claim 1 and further including means for resiliently biasing said movable top plate means against said stationary base plate.

4. The bag top folder as in claim 1 and further including means for resiliently biasing said movable front blade means toward said vertical edge of said stationary base plate.

5. The bag top folder as in claim 1 wherein said second folder means is slidably mounted on said top plate means.

6. The bag top folder as in claim 5 wherein said second folder means is resiliently biased against lateral movement with respect to said top plate means.

7. The bag top folder as in claim 1 wherein the movement of the top of a bag against said working edge of said first folder means bends a portion of the top of said bag 90° from the vertical.

8. The bag top folder as in claim 7 wherein the movement of said bag passed said second folder means bends said portion of the top of said bag an additional 90°.

9. The bag top folder as in claim 1 and further including a flap guide member affixed to the upper surface of said movable front blade means and having a working edge aligned with said working edge of said movable front blade means proximate the leading edge of said front blade means.

10. The bag top folder as in claim 1 wherein said movable front blade means has a clearance slot extending parallel to said working edge of said front blade means for receiving the top portion of a bag as it is folded.

11. The bag top folder as in claim 1 and further including means for adjusting the elevation of said front blade means relative to the elevation of said stationary base plate and means for adjusting the spacing between the working edge of said front blade means and said vertical edge of said base plate.

12. A bag top folder as in claim 1, said second folder means having a tapered working edge extending downwardly for engaging the bent portion of said top of said bag exiting from said first folder means and forcing said bent portion vertically downward.

13. The bag top folder as in claim 12 wherein said second folder means is resiliently mounted with respect to said frame.

14. The bag top folder as in claim 13 wherein said second folder means is resiliently mounted with respect to said frame and yieldable in both a lateral and vertical direction.

15. The bag top folder as in claim 13 wherein said first and second folder means are mounted on a rotatable plate such that the working edges thereof may be rotated to a disposition out of alignment with said straight line path.

16. The bag top folder as in claim 15 wherein said rotatable plate is spring biased toward said frame.

* * * * *